United States Patent [19]

de Vries

[11] 4,388,550

[45] Jun. 14, 1983

[54] GAS DISCHARGE DISPLAY PANEL HAVING HOLLOW CATHODES

[75] Inventor: Gerhard H. F. de Vries, Eindhoven, Netherlands

[73] Assignee: U.S. Philips Corporation, New York, N.Y.

[21] Appl. No.: 192,745

[22] Filed: Oct. 1, 1980

[30] Foreign Application Priority Data

Oct. 10, 1979 [NL] Netherlands ..... 7907489

[51] Int. Cl.³ ..... H01J 61/08; H01J 61/30

[52] U.S. Cl. ..... 313/585; 313/584

[58] Field of Search ..... 313/189, 188

[56] References Cited

U.S. PATENT DOCUMENTS 3,662,214 5/1972 Lustig ..... 315/169.4 X 3,700,946 10/1972 Caras ..... 313/188

3,701,918 10/1972 Allen et al. ..... 313/209

3,766,420 10/1973 Ogle et al. ..... 313/484

*Primary Examiner*—Robert Segal

*Attorney, Agent, or Firm*—Paul R. Miller

[57] ABSTRACT

In a gas discharge display panel, a plurality of gas discharge cells are arranged between a plurality of display anode conductors and a cathode conductor. The cathode conductor is formed of hollow cathodes having cavities with apertures facing the display anode conductors. The hollow cathodes widen from the apertures on the side remote from the display anode conductors up to a transverse dimension a and extend in a direction from the anode conductors to a depth b with the transverse dimension a being at least three times the depth b. In this manner, the cavities of the hollow cathodes extend substantially parallel to the cathode conductor, and in addition, can be manufactured in a simple manner.

9 Claims, 6 Drawing Figures

GAS DISCHARGE DISPLAY PANEL HAVING HOLLOW CATHODES

The invention relates to a gas discharge display panel comprising a row of gas discharge cells which can be ignited selectively and which are situated between a plurality of display anode conductors and a cathode conductor having a row-wise series of hollow cathodes, each having a cavity with an orifice opposite to a respective display anode conductor.

U.S. Pat. No. 3,701,918 discloses a gas discharge display panel having hollow cathodes. The hollow cathodes are formed by apertures provided in a dielectric plate having walls covered with conductive cathode material.

A similar display panel is disclosed in U.S. Pat. No. 3,662,214. In this panel the hollow cathodes consist of metal tubes which are secured in cylindrical holes provided in a dielectric plate.

Compared with solid cathode constructions in which the discharge occurs at the outer surface of the cathode, a hollow cathode has a number of important advantages. The efficiency of the discharge when using a hollow cathode is considerably larger than when a solid cathode is used. That is to say, a discharge using a hollow cathode has a larger current density at the same operating voltage. Another advantage is that the material sputtered from the cathode during the discharge is substantially retained within the hollow cathode.

In the above-mentioned known panels, the cylindrical cavities of the cathodes extend perpendicularly to the display panel with a uniform diameter over a distance larger than the diameter so that the thickness (depth) of the panel is determined to a considerable extent by the length of the cylindrical cavities. Furthermore the manufacture of panels with such hollow cathode constructions is particularly complicated and unfit for series production.

It is an object of the invention to provide a gas discharge picture display panel having hollow cathodes, which panel can be manufactured simply and in addition may have a small depth, that is to say a panel in which the dimensions of the hollow cathodes do not substantially determine the thickness of the display panel.

According to the invention, a gas discharge picture display panel comprising a row of gas discharge cells which can be ignited selectively and which are situated between a plurality of display anode conductors and a cathode conductor with a row-wise series of hollow cathodes each having a cavity with a orifice opposite to a respective display anode conductor is characterized in that the hollow cathodes, viewed from the orifices, widen in a direction parallel to the cathode conductor up to a transverse dimension a and extend away from the anode conductors to a depth b in such manner that $a>b$. In this manner a gas discharge display panel is obtained in which the hollow cathodes mainly extend substantially parallel to the display panel. The transverse dimension a of a hollow cathode is preferably at least three times the depth b thereof.

The cathode conductor may consist of a first metal strip and a second metal strip extending on and along the first strip. The second metal strip has a row-wise series of apertures, which widen on the side facing the first metal strip and which on the side remote from the first metal strip form orifices so as to establish the row of hollow cathodes.

The widened portions of the hollow cathodes of the cathode conductor may merge into each other forming a common space to the orifices and extending parallel to the second plane. The cathode conductors may then each consist of a hollow bar having a wall facing the display anode conductors provided with a row-wise series of apertures to form the orifices.

The invention may be applied both to gas discharge display panels of the type having a set of display anode conductors, and to those of the type having a set of display anode conductors and a set of auxiliary anode conductors. In the latter case, the cathode conductors may then form display cells with the display anode conductors (display anodes) and form auxiliary discharge cells with the auxiliary anode conductors (auxiliary anodes), wherein the auxiliary discharge cells are used for igniting the display cells. As is known, the display anode conductors and the auxiliary anode conductors may be situated on the same side of the cathode conductor or on opposite sides of the cathode conductor. In the latter case the hollow cathodes are each provided further with an orifice on the side facing the auxiliary anodes. In the case of a display panel having display anodes and auxiliary anodes, situated on opposite sides of the cathode conductor, the cathode conductor according to a particular embodiment of the invention may be formed by a first metal plate having an array of first apertures and a contiguous second metal plate having an array of second apertures aligned with the first apertures wherein on the facing sides of the first and second metal plate the first and/or second apertures widen so as to establish an array of hollow cathodes where the first and second apertures form first and second orifices.

Embodiments of the invention will now be described in greater detail, by way of example, with reference to the accompanying diagrammatic drawings, in which.

Figure 1:
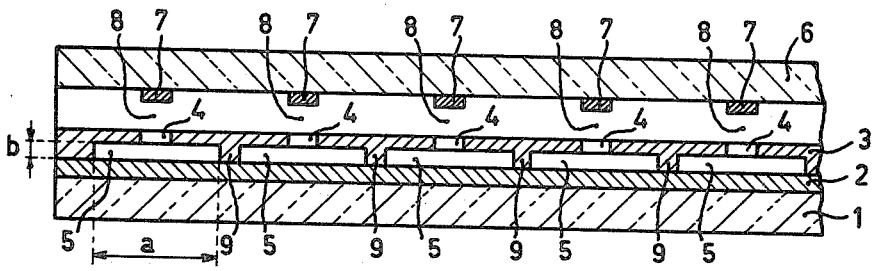
FIG. 1 is a schematic cross-sectional view of an embodiment to illustrate the principle of the invention.

In the sectional view of FIG. 1, a first metal strip 2 having a thickness of 0.05 mm and a width of 0.5 mm is present on a glass substrate 1. A second metal strip 3 is situated on the first metal strip 2 and has a row-wise series of apertures 4. The apertures 4 widen from 0.1 mm up to a transverse dimension a of approximately 1 mm. The strip 2 together with the strip 3 constitutes a cathode conductor having cavities 5 which mainly extend parallel to the cathode conductor (2, 3) and which each have an orifice formed by the narrow portion of the apertures 4. The depth b of the cavities 5 is approximately 0.2 mm so that the transverse dimension a is approximately five times the depth b. A glass top plate 6 is provided with display anode conductors 7 extending transversely to the cathode conductor (2, 3). The space between the glass plates 1 and 6 is filled with an ionizable gas, for example neon or a mixture of neon and argon. The display anode conductors 7 constitute with the cathode conductor (2, 3) a row of gas discharge cells 8 which can be ignited selectively by selective energisation of the anodes 7. With a filling of neon, the operating voltage at a current between 0 and 5 mA is approximately 110 V, and with a neon-argon mixture (Penning mixture) the operating voltage is approximately 90 V. Compared with a solid cathode construction, the operating voltage with a hollow cathode construction is approximately 40 Volts lower with the same current. Apart from this advantage, the construction shown in FIG. 1 is easy to manufacture. The strip 2 may consist of a metal strip which is provided on the glass plate 1 by a known method such as vapour deposition, sputtering or electro-deposition. The widening apertures 4 can be provided in the strip 3 which consists, for example, of nickel-iron by a two-sided etching treatment. The walls 9 between the cavities 5 are not necessary. The cavities 5 may merge into each other in the longitudinal direction of the strips 2 and 3 to form one common cavity. In that case spacer blocks may be present between the strip 3 and the strip 2 so as to prevent sagging of the strip 3.

In another simple method of manufacturing the cathode conductor, the hollow cathodes are obtained by the selective etching of three metal layers provided one on top of the other on the glass plate 1. In this method a first metal layer contiguous with the glass plate is, for example, chromium-nickel-iron, and has thereon a second metal layer of, for example, copper and finally a third metal layer of, for example, chromium-nickel-iron. The narrow portions of the apertures 4 are etched in the third metal layer and the cavities 5 are then obtained in the apertures 4 by means of a selective etchant which removes the metal of the second layer but does not remove the metal of the first and third layers.

Figure 3:
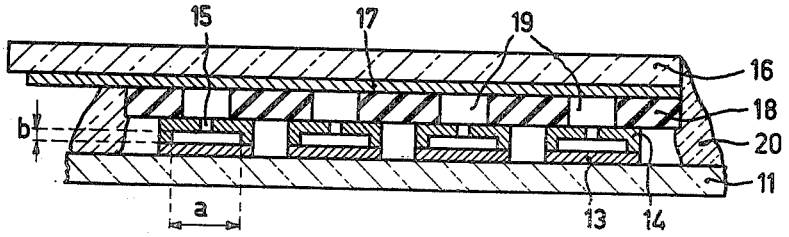
FIG. 3 is a sectional view of the assembled panel taken on the line III—III of FIG. 2.
Figure 2:
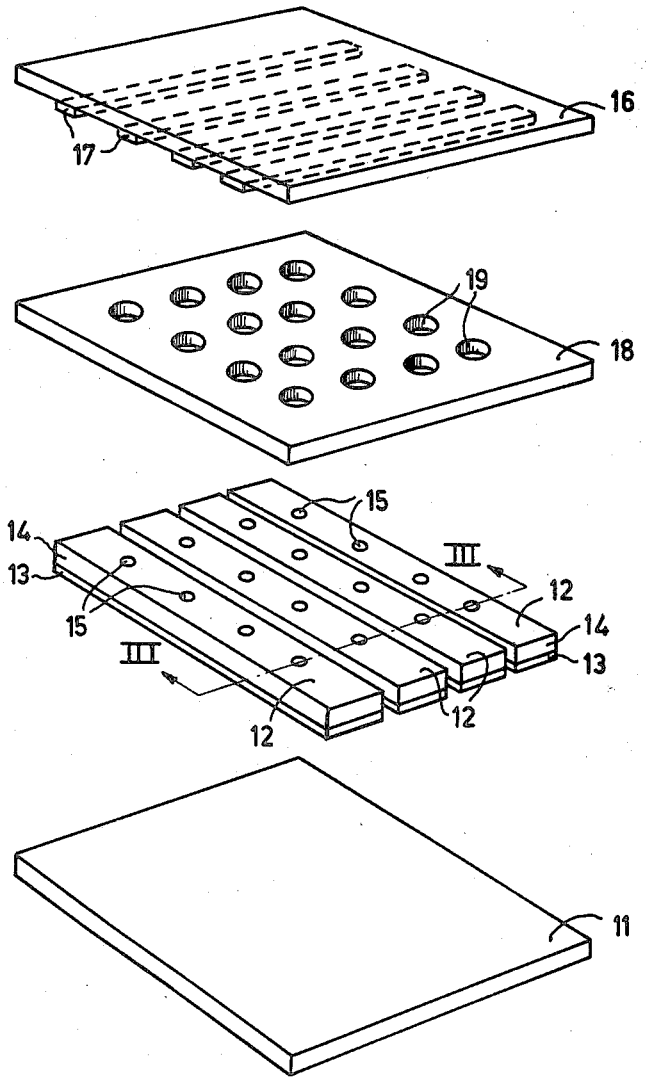
FIG. 2 is a perspective exploded view of a gas discharge display panel embodying the invention.

FIGS. 2 and 3 show a gas discharge display panel using the construction schematically shown in FIG. 1. A plurality of cathode conductors 12 each consisting of two metal strips 13 and 14 placed one on top of the other are provided on a glass plate 11, analogously to the strips 2 and 3 as described with reference to FIG. 1. The strips have a width of 0.3 mm, and the strips 14 are provided with apertures 15 analogous to the apertures 4 in FIG. 1. The cathode conductors 12 are separated by gaps of 0.1 mm. In the longitudinal direction of the cathode conductors the apertures 15 have a pitch of 0.3 mm. The cavities of hollow cathodes visible in the sectional view of FIG. 3 have a depth b of approximately 0.05 mm and a transverse dimension a of approximately 0.25 mm. Display anode conductors 17 which cross the cathode conductors 12 above the apertures 15 are provided on a glass top plate 16. The display anode conductors 17 are spaced from the cathode conductors 12 by an insulating intermediate plate 18 of 0.3 mm thickness. The intermediate plate 18 has apertures 19 with a diameter of 0.2 mm and aligned with the apertures 15. By sealing the plates 11 and 16 at the edges in a gas-tight manner with a sealing glass 20 (FIG. 3), a gas discharge display panel is obtained with gas discharge cells which are arranged in a matrix of rows and columns and which can be ignited selectively.

The panel can in principle be used for displaying pictures, digits or letters. It is possible, without departing from the principle of the invention, to take special measures in the panel to stimulate the ignition of the gas discharge cells (display cells). Such measures may consist, for example, of the use of auxiliary discharges in the form of starter cells, keep alive cells and auxiliary discharge cells for preconditioning the display cells. Such measures are described in inter alia U.S. Pat. No. 3,766,420.

Figure 4:
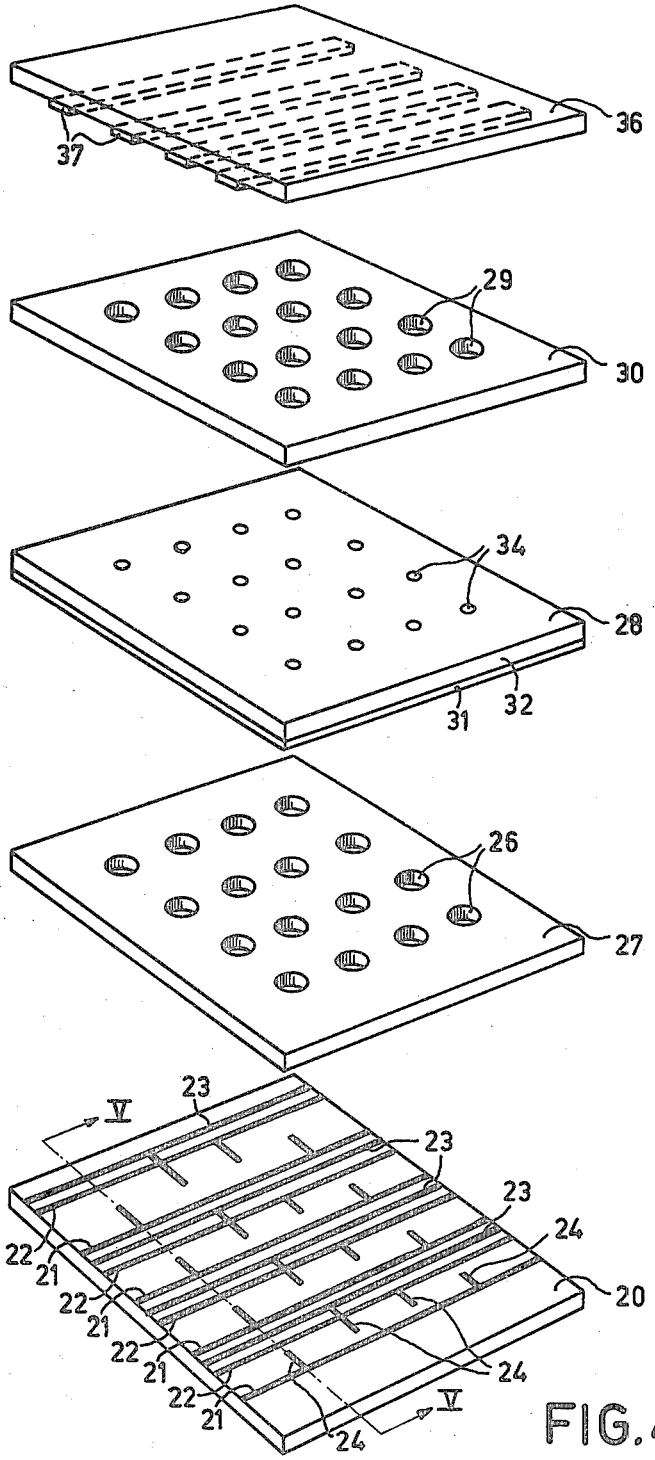
FIG. 4 is an exploded view, analogous to FIG. 2, of another embodiment of the invention.
Figure 5:
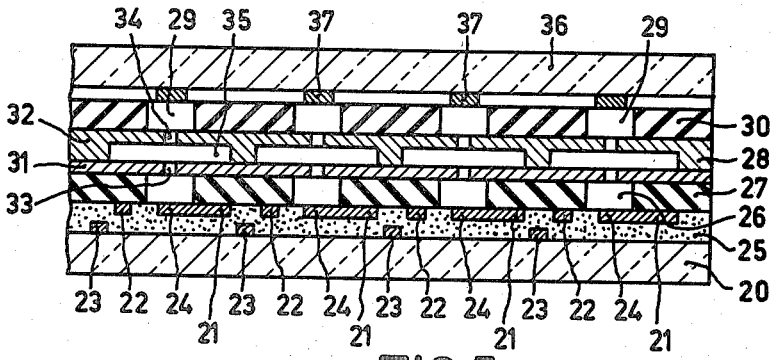
FIG. 5 is a sectional view, analogous to FIG. 3, taken on the line V—V of FIG. 4.

FIG. 4 and FIG. 5 show an embodiment of the invention in which auxiliary discharge cells are used to ignite the display cells. Auxiliary anode conductors 21, 22 and 23 are provided on an insulating (glass) plate 20. The auxiliary anode conductors 21, 22 and 23 are provided with transverse tracks 24 and are insulated from each other by a thin insulation layer 25 (see FIG. 5). An insulating plate 27 having apertures 26 is situated on the plate 20 with the apertures 26 above the transverse tracks 24. In the region of an aperture 26, the insulation is removed from the transverse tracks. A common cathode conductor in the form of a metal plate 28 is situated between the insulating plate 27 and an insulating plate 30 having apertures 29. In an analogous manner to the cathode conductors 12 of FIG. 2, the cathode conductor 28 consists of a first metal plate 31 and a second metal plate 32. The plate 31 corresponds to the strip 14 of FIG. 2 with the difference that the plate 31 is provided with apertures 33 (see FIG. 5) which are aligned with the apertures 26 and 29 of the insulating intermediate plates 27 and 30, respectively. The metal plate 32 has apertures 34 which widen on the side facing the metal plate 31 so that cavities 35 are obtained. A glass top plate 36 is provided with display anode conductors 37 and is situated on the insulating intermediate plate 30. The apertures 29 constitute the display cells and the apertures 26 constitute the auxiliary discharge cells.

Figure 6:
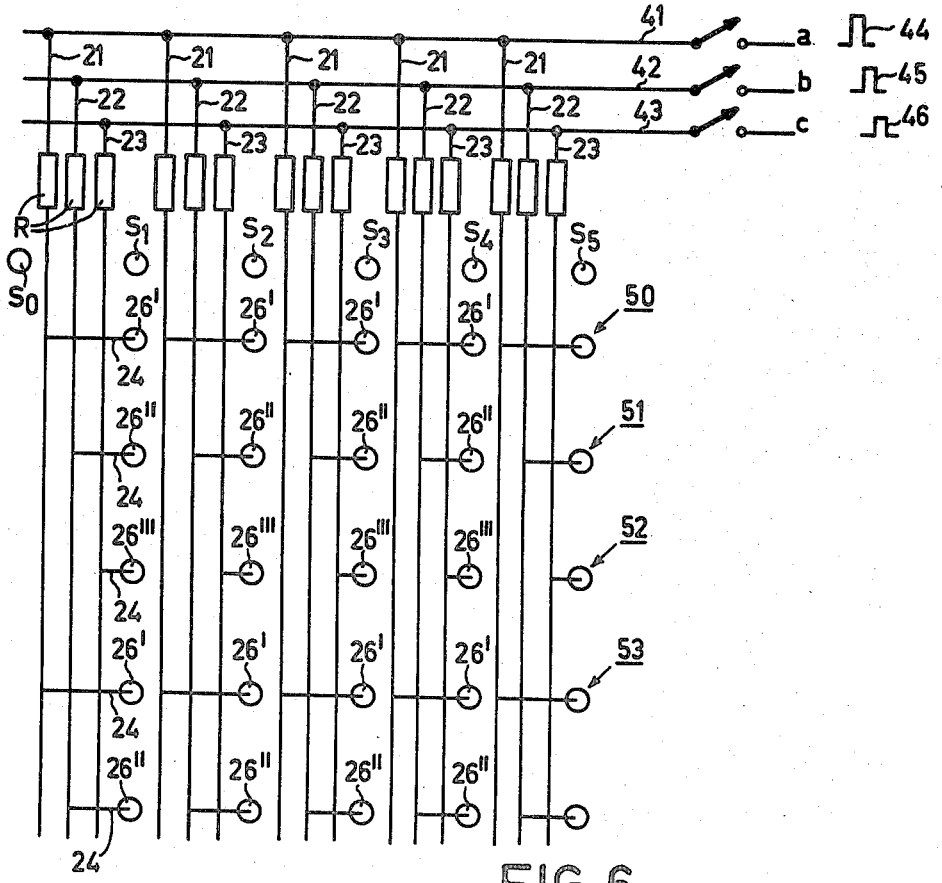
FIG. 6 illustrates one way of driving the gas discharge display panel shown in FIGS. 4 and 5.

One manner of driving the panel of FIGS. 4 and 5 will be described with referece to FIG. 6. The auxiliary anode conductors 21, 22 and 23 are interconnected in groups, namely a group of auxiliary anode conductors 21, a group of auxiliary anode conductors 22 and a group of auxiliary anode conductors 23. A resistor R of approximately 300 kOhm is incorporated in each of the auxiliary anode conductors 21, 22 and 23. The auxiliary discharge cells 26', 26'' and 26''' with the transverse tracks 24 are shown schematically in FIG. 6.

The panel comprises an extra row of auxiliary discharge cells in the form of starter cells $S_1$, $S_2$, $S_3 \ldots S_n$. For the rapid ignition of the starter cells $S_1 \ldots S_n$, a continuously-energized keep-alive cell $S_o$ is used. Ionized and meta-stable particles flow from the keep-alive cell to the first starter cell $S_1$ so that when cell $S_1$ is energized it ignites immediately. Ionized and meta-stable particles then similarly flow from the cell $S_1$ to the starter cell $S_2$ so that upon energisation this cell $S_2$ also ignites immediately. By successively energizing the starter cells $S_1 \ldots S_n$, the whole row of starter cells $S_1 \ldots S_n$ is ignited. When the starter cells $S_1 \ldots S_n$ are operative, metastable and ionized particles flow to the nearest row of auxiliary discharge cells, i.e. the row 50 of cells 26', so that these cells are brought into a state in which they can readily ignite. By closing a switch a, all cells 26' connected to the anode conductors 21 are energized with an ignition pulse 44 by a conductor 41, but only the cells 26' of the first row 50 will ignite because the conditions for ignition are more favourable than in all the remaining cells 26' owing to the metastable and ionized particles present therein. The starter cells $S_1 \ldots S_n$ are now extinguished. Metastable and ionized particles flow from the cells 26' in the first row 50 to the second row 51 of discharge cells 26''. Switch a is now opened and switch b is closed. As a result, all the cells in the row 50 are extinguished and all the cells 26'' connected to the axuiliary anode conductor 22 are energized with an ignition pulse 45 by a conductor 42. For the above-mentioned reason, however, only the row 51 of cells 26'' will ignite. Analogously, by closing a switch c and opening the switch b, all the cells 26''' connected to the auxiliary discharge anodes 23 by a conductor 43 are energized with an ignition pulse 46. However, only the row of cells 26''' denoted by 52 are ignited, while the cells 26'' in the row 51 are extinguished. Switch c is then opened and switch a is closed so that the row of cells 26' denoted by 53 is ignited. All rows of cells are successively ignited and extinguished in this manner. When the last row of cells has been ignited and extinguished, the row of starter cells $S_1 \ldots S_n$ is again energized and by the cyclic opening and closing of the switches a, b and c, each row of the auxiliary discharge cells is successively ignited and distinguished again. This cycle is repeated for the whole panel many times per second, usually approximately seventy times per second. Each time a row of auxiliary discharge cells is operative, metastable and ionized particles also flow to the overlying row of display cells 29 (see FIG. 5). When, simultaneously with the operation of a row of auxiliary discharge cells, the display anodes 37 are energized in accordance with the display information for the overlying row of display cells 29, the row of display cells 29 will ignite in accordance with the display information. By energizing the anode conductors 37 synchronously with the scanning of the rows of auxiliary discharge cells 26, the information to be displayed is thus built up row by row with the above given frequency of approximately seventy frames per second.

What is claimed is:

1. A gas discharge display panel comprising a plurality of display anode conductors, a cathode conductor having at least a row-wise series of hollow cathodes, each of said hollow cathodes being a cavity with a first aperture opposite to a respective display anode conductor, wherein said cathode conductor consists of at least one first metal strip and at least one second metal strip extending on and along said first metal strip, said second metal strip having a row-wise series of said first apertures opening toward said first metal strip, and wherein said hollow cathodes are disposed between said first metal strip and said second metal strip at said first apertures, at least one row of selectively ignitable gas discharge cells disposed between said plurality of display anode conductors and said cathode conductor, wherein said hollow cathodes extend by a transverse dimension a parallel to said cathode conductor and away from said anode conductors by a depth dimension b where $a>b$.

2. A gas discharge display panel according to claim 1, wherein said transverse dimension a is at least three times said depth dimension b.

3. A gas discharge display panel according to claim 1, wherein said cavity of each of said hollow cathodes extend into one another to provide a common cavity extending parallel to said cathode conductor.

4. A gas discharge display panel according to claim 1, wherein a plurality of first and second metal strips are provided to form an array of said hollow cathodes.

5. A gas discharge display panel comprising a plurality of display anode conductors, a cathode conductor having at least a row-wise series of hollow cathodes, each of said hollow cathodes being a cavity with a first aperture opposite to a respective display anode conductor, at least one row of selectively ignitable gas discharge cells disposed between said plurality of display anode conductors and said cathode conductor, wherein said hollow cathodes extend by a transverse dimension a parallel to said cathode conductor and away from said anode conductors by a depth dimension b where $a>b$, wherein a plurality of auxiliary anode conductors is disposed opposite to said cathode conductor from said display anode conductors to provide auxiliary discharge cells, each of said hollow cathodes having said cavity provided with a second aperture facing said auxiliary anode conductors, and wherein said cathode conductor is provided by a first metal plate having an array of said first apertures and a contiguous second metal plate having an array of said second apertures in alignment with said first apertures, and wherein said hollow cathodes are disposed in an array between said first and second metal plates with said first and second apertures opening to said hollow cathodes.

6. A gas discharge display panel according to claim 5, wherein a first insulating plate is disposed between said cathode conductor and said display anode conductors, said first insulating plate having an array of first orifices in alignment with and larger than said first aperture to form said gas discharge cells, and wherein a second insulating plate is disposed between said cathode conductor and said auxiliary anode conductors, said second insulating plate having an array of second orifices in alignment with and larger than said second apertures to form said auxiliary discharge cells.

7. A gas discharge display panel according to claim 6, wherein said auxiliary anode conductors include three sets of conductive tracks insulated from one another in an insulating layer, and wherein each of said conductive tracks have transverse tracks extending below said second orifices to provide said auxiliary anode conductors.

8. A gas discharge display device according to claim 5, wherein said transverse dimension a is at least three times said depth dimension b.

9. A gas discharge display panel according to claim 1, wherein a first insulating plate is disposed between said cathode conductor and said display anode conductors, said first insulating plate having an array of orifices in alignment with and larger than said first apertures to form said gas discharge cells.

* * * * *